US007066821B2

(12) United States Patent
Langford

(10) Patent No.: US 7,066,821 B2
(45) Date of Patent: Jun. 27, 2006

(54) WATERSLIDE WITH LEVEL EQUALIZATION CONDUITS COUPLING BETWEEN RUN-OUT LANES

(76) Inventor: Frederick Langford, 212 Crest Rd., Cape May Court House, NJ (US) 08210

( * ) Notice: Subject to any disclaimer, the term of this patent is extended or adjusted under 35 U.S.C. 154(b) by 0 days.

(21) Appl. No.: 10/878,707

(22) Filed: Jun. 28, 2004

(65) Prior Publication Data

US 2005/0288113 A1 Dec. 29, 2005

(51) Int. Cl.
*A63G 21/18* (2006.01)

(52) U.S. Cl. ..... 472/117; 472/128

(58) Field of Classification Search ..... 472/116, 472/117, 128, 129; 104/69, 70; D21/818, D21/819

See application file for complete search history.

(56) References Cited

U.S. PATENT DOCUMENTS 3,490,765 A * 1/1970 Moulton ..... 472/116
D266,346 S * 9/1982 Millay et al. ..... D21/819
4,805,896 A * 2/1989 Moody ..... 472/117
5,011,134 A 4/1991 Langford
5,020,465 A 6/1991 Langford
5,137,497 A * 8/1992 Dubeta ..... 472/88
5,213,547 A * 5/1993 Lochtefeld ..... 472/117
5,230,662 A 7/1993 Langford
5,453,054 A 9/1995 Langford
5,540,622 A * 7/1996 Gold et al. ..... 472/117
5,779,553 A 7/1998 Langford
6,053,790 A 4/2000 Langford

* cited by examiner

*Primary Examiner*—Kien Nguyen
(74) *Attorney, Agent, or Firm*—Duane Morris LLP

(57) ABSTRACT

A waterslide amusement course proceeds from a higher elevation to a lower elevation, with a water pooling area to produce fluid drag that slows or stops the riders, especially at the end of the course. The course is divided into lanes at the pooling area, for example by curbs protruding above the water level. Arriving riders displace water from their lanes and the lanes are coupled to permit level-equalizing flow. The pooling area can have a weir, lip, upwardly sloping bottom or similar obstruction forming pools in the lanes. Water can pass through gaps in the curbs, around ends of the curb and preferably flows through a connecting conduit that couples between the lanes at an end wall of a box-like enclosure subdivided by lanes in the pooling area.

6 Claims, 4 Drawing Sheets

WATERSLIDE WITH LEVEL EQUALIZATION CONDUITS COUPLING BETWEEN RUN-OUT LANES

BACKGROUND OF THE INVENTION

1. Field of the Invention

The invention concerns waterside amusement rides wherein riders move downhill to a terminal run-out area containing a quantity of water intended to slow the riders by turbulence and fluid drag, particularly wherein the configuration is subdivided into lanes. According to an aspect of the invention, two or more run-out lanes are coupled by supplemental flow conduits that equalize the water level among the lanes.

2. Prior Art

Waterslide amusements are known, for example from U.S. Pat. Nos. 6,053,790; 5,779,553; 5,453,054; 5,230,662; 5,020,465; and 5,011,134, all to F. Langford. The disclosed waterslides have generally downhill gradients whereby the riders pick up speed over at least part of a course, leading eventually to an endpoint at a low elevation. The course is defined by a channel, tube or similar sluice structure having a bottom and lateral walls at least to the height of a curb and possibly higher. The sluice structure either carries a flow of water or provisions are made to keep the surfaces smooth and wet for low friction sliding. The riders might rest on mats or might be carried by flotation tubes. Sometimes the riders simply slide along on their skin and bathing suits.

The nature of particular waterslide amusements varies. There are relative higher and lower water volume rides. The linear velocity of the water and/or rider may be higher or lower. The riders may float on the water, be carried in the water or may slide over a wetted surface, depending on factors including the downhill gradient and length of the ride, the rate and manner in which water is inserted along the path, the use of curves and corresponding banking, interspersing of flat pooling areas, etc.

Waterslide amusements that enable riders to develop substantial linear velocity often are provided with structures that allow the riders to skim over a modest volume of water wetting the surfaces along the course and flowing down hill. To a limited extent, the rider can control his or her acceleration and speed, for example by applying drag and the course may be arranged specifically for faster and slower runs between the start and the finish. Generally, speed is advantageous. Other things being equal, the waterside designer often will choose structural options that build and maintain substantial linear speed. By providing a downhill gradient, at least near the end of the course, particularly a gradient structured so that acceleration by gravity exceeds friction, the riders can be accelerated right to a "finish" line in an exciting manner.

At the conclusion of the ride, the riders must be slowed to a stop. An apt and exciting way to stop or at least slow down riders moving at high speed can be to direct the riders into a pool. Preferably, the course directs fast moving riders at a low angle of incidence onto the surface of a pool. At the end of a course, such a pool is typically called the "splash down" pool. This pool is an accumulation of standing water or slow moving water that is sufficiently deep and is encountered by the rider for a sufficient time that the rider sinks progressively into the pool. The increasing rider depth changes the dynamics from skimming the surface to movement of the rider relative to the water in the pool. The resulting fluid drag halts the rider as the rider sinks into the pool. An exciting aspect of the experience is that entering the pool often produces a very substantial splash.

Waterslides advantageously are structured with parallel tracks such that plural riders starting at the same time can race or at least accompany one another down the slide at the same time. The parallel tracks are subdivided from one another by an intervening curb that keeps the riders from interfering with one another by colliding or otherwise making contact. The plural riders traversing the course at the same time are in danger of injury if they should collide in a splash down pool. Therefore, the curbs that subdivide the riders' tracks generally continue into the splash down zone, each rider having a separate pool between adjacent curbs.

A splash down pool need not be very deep, the necessary fluid drag being produced by a few inches of depth. Inasmuch as the splash down pool is the lowest elevation along the ride, the pool may provide the sump area at which water flowing down the course with the riders is collected to be pumped back to a higher elevation. The splash down pool may be arranged to overflow into yet a lower course, for example to overflow into a lower water course such as a "lazy river" that generally collects overflow to be pumped back to the beginning of various waterslide courses.

A splash down pool needs to accumulate water for fluid drag purposes. Assuming that the splash down pool also needs to overflow, a far end of the splash down pool needs to have a low rim or lip. Optionally, a splash down pool can become progressively shallower leading up to the overflow rim or lip. The change in the contour of the bottom approaching the end, such as a terminal ramp and/or lip, is necessary to retain a depth of water leading up to the end. Without a decrease in depth at the ramp or lip, the water would flow freely over the end instead of accumulating in a pool.

If the length and depth of a splash down pool are marginally sufficient to stop riders, then making the bottom of the splash down pool slope upwardly toward the surface in an ending ramp can provide a low impact surface that tends to catch some persons who have traversed the length of the splash down pool, perhaps more abruptly than fluid drag. A raise lip at the overflow end can also provide a form of obstruction. However, the shallower water lacks the fluid drag of deeper water. A rider who skims the surface of the splash down pool for a substantial distance may come up hard against such an end obstruction or ramp, or may be abraded by it.

These disadvantages are exacerbated if a very large person precedes another rider down the same waterslide lane, the large person can splash a large part of the water out of the splash down zone between the curbs corresponding to that lane. The large person likewise may sweep a quantity of the water over the end overflow. Although the large person may not be affected adversely, less water remains in the splash down zone of that lane to slow down the next person. The next rider may tend to skim farther and faster along the splash down zone or may slide up against or onto a an end part of the terminal ramp.

Waterslide riders vary widely in age, weight and stature, and advantageously, all riders should be equally accommodated. Substantial attention is paid in designing waterslides to plan for riders over a range of sizes. Thus, for example, a minimum water depth is calculated for fluid drag. The run-out lane length is calculated to be at least sufficient for the fastest expected rider. Such planning and calculations, however, depend on certain conditions, such as having a nominal amount of water in the run-out lane. Although continuing arrival of gushes or flows of water can replenish water removed from the run-out lane, it would be advantageous if the presence of sufficient water to meet design constraints could be reasonably expected.

SUMMARY OF THE INVENTION

An inventive solution to the foregoing problems and challenges of waterslide design uses a run-out lane configuration wherein the water levels are equalized between lanes that are subdivided by curbs, using flow conduits that equalize such levels.

A waterslide amusement course proceeds from a higher elevation to a lower elevation, with a water pooling area to produce fluid drag that slows or stops the riders, especially at the end of the course. The course is divided into lanes at the pooling area, for example by curbs protruding above the water level. Arriving riders displace water from their lanes. The lanes are coupled together in a manner that permits level-equalizing flow. Water can pass through gaps in the curbs, around ends of the curb and preferably flows through a connecting conduit that couples between the lanes.

In an advantageous embodiment, the level equalizing conduits are coupled to a rear end wall of a box-like enclosure subdivided by lanes at the pooling area. Arriving riders encounter the pooling area in a direction moving away from said end wall. As a result, when an arriving rider displaces water from a lane, primarily in a direction away from the end wall, flow from the equalizing conduit follows out behind the rider, quickly replenishing at least part of the displaced water.

In an advantageous embodiment, the lanes used for run-out lanes are provided in a pool enclosure at the end of a waterslide course, into which the riders are injected from a downhill gradient section from which the riders meet the pooling area at a low angle of incidence relative to the surface of the water in the pooling area. Riders splash into their run-out lanes, displacing water out of the lane into adjacent lanes and sweeping water before them toward a drainage end as the riders slow down. In the process, a large person can deplete the water level in the lane. If a next rider arrives promptly, an insufficient quantity may remain for use by the next rider, who may be slowed only marginally among other difficulties. According to an inventive aspect, by coupling the lanes with equalizing flow conduits, the level in a depleted lane is replenished with water from one or more other lanes. As a result of averaging of levels, the depletion of any given lane is reduced to a fraction. The conduits can involve large diameter pipes coupling lanes of a terminal pool at a concealed area behind the entry at the downhill gradient section.

The invention is also applicable to variations that have corresponding elements, for example the invention is applicable to intermediate pooling areas on a course. The equalizing function of the conduits behind the entry of the downhill gradient as described can be met wholly or partly by alternatives including flow conduits running under the lanes, through gaps in curbs defining the lanes and/or around terminal ends of the curbs leading to an upwardly sloping exit area approaching the drainage end lip.

The inventive waterslide includes a sliding course for riders proceeding from a higher elevation to a lower elevation. At least one water pooling area is provided along the course where water accumulates by gravity to a depth providing fluid drag for slowing the riders when encountering the water pooling area.

The sliding course is subdivided into lanes at the pooling area. The lanes are subject to displacement of water by splashing and/or being swept forward along the course, particularly when encountered by a large fast moving rider. In order to address the problems that arise from the water level being less than a nominal level, the invention equalizes the level of water between the depleted lane and one or more other the lanes where the water level is higher.

At least one flow passage such as a conduit couples between such lanes of the pooling area. The flow conduit carries a flow of water between the lanes in the pooling area, whereby the levels of water in the lanes of the pooling area are better equalized.

The invention is aptly applied to a racing waterslide course with a number of laterally adjacent coextensive lanes that riders can traverse alongside one another. The course involves a downhill gradient, optionally with variations in slope and direction for added excitement. The lanes are subdivided by curbs and lead into a splashdown pooling area. In a preferred arrangement, the pooling area is configured more or less as a box with side walls and end walls. The side walls are located laterally outside the outermost of the lanes, and extend parallel to curbs that subdivide the pooling area into the lanes between the sidewalls, preferably numbering six or eight, but possibly being only two. The end wall in the forward direction forma an overflow lip that determines the maximum level of water in the pooling area, for at least one of the lanes, and can drain into a lower elevation collection zone, a "lazy river" ride or simply a sump where the water is accumulated to be pumped back for re-use.

A second end wall of the pooling area, opposite from the lip, actually is concealed behind the downhill gradient of the sliding course that defines a sloping entry for the riders into the pooling area at a point between the pooling area end walls. The conduits in a proven example of the invention comprise four inch PVC pipes that join sets of three adjacent lanes into a level equalization subset of the lanes.

The riders move into the pooling area in a direction proceeding away from that second or rearward end of the pooling area and toward a drainage or beaching end at which the bottom slopes upwardly, riders normally leave the run-out area, and excess water drains off in the forward direction. However, riders can displace the water in that forward direction and deplete the level in a lane.

Furthermore, when the water in a lane becomes partially depleted in this way and the refilling process relies on the exit pool for equalization, a wave can propagate backward from the beaching end, moving in the opposite direction from the next rider to arrive, i.e., backwards up into the lane. This can cause an objectionable hydraulic bump for that rider. The equalization pipes under the final down-slope according to the invention, coupling the lanes at the beginning of the run-out, feed a depleted lane of the run-out in the same direction that the rider is moving. Therefore, although a rider may deplete a lane by forcing water forward like a piston in a cylinder, the replenishing flow comes up from behind that rider to help to fill the depleted length of the lane. This reduces the amplitude of the reflected hydraulic bump.

Additional aspects will become apparent in connection with the following discussion of examples.

BRIEF DESCRIPTION OF THE DRAWINGS

There are shown in the drawings certain examples for illustrating aspects of the invention. However the invention is subject to embodiment using various combinations and applications of such aspects, not limited to the particular embodiments shown. In the drawings.

DETAILED DESCRIPTION

Figure 1:
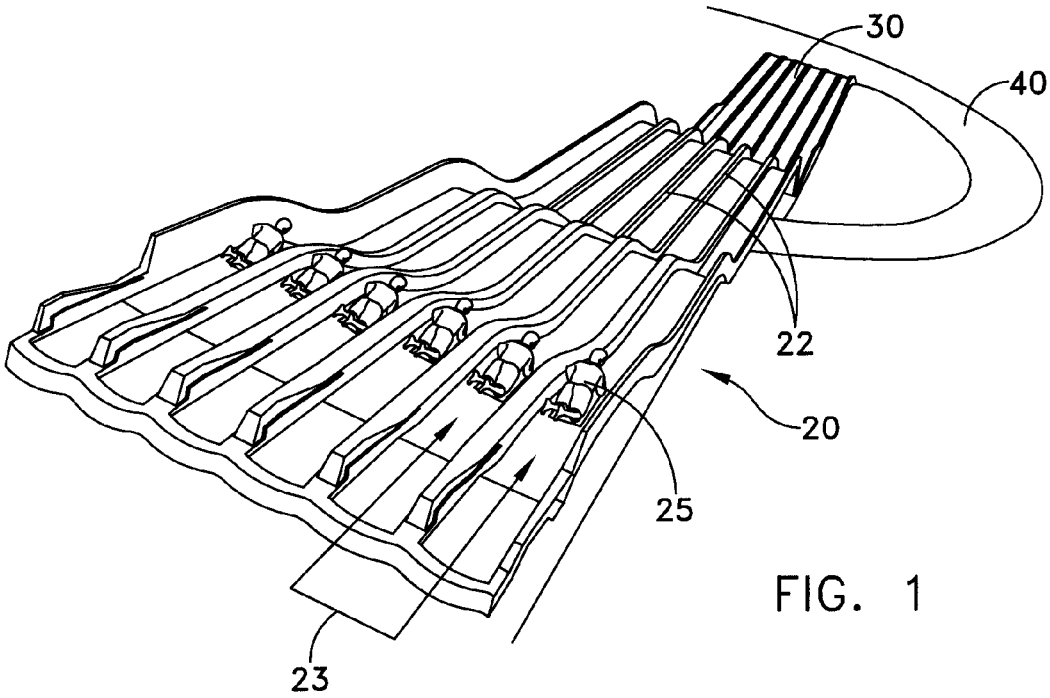
FIG. 1 is a perspective view of a multiple lane waterslide for illustrating aspects of the invention, the riders having just commenced a run.
Figure 2:
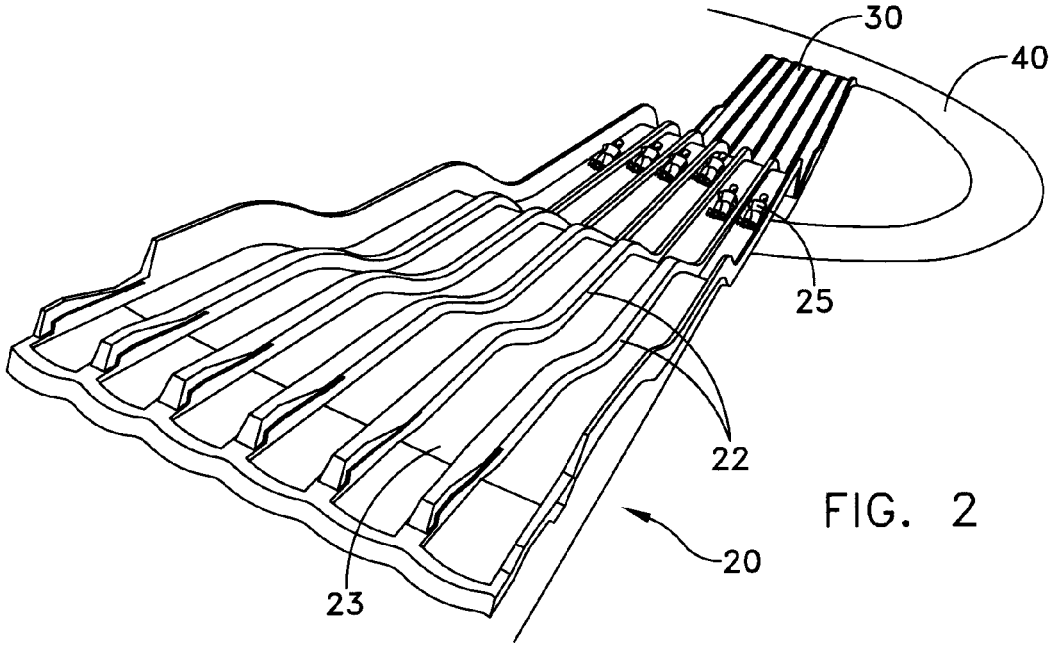
FIG. 2 is a perspective view of the same riders approaching the terminal pool area of the waterslide.
Figure 3:
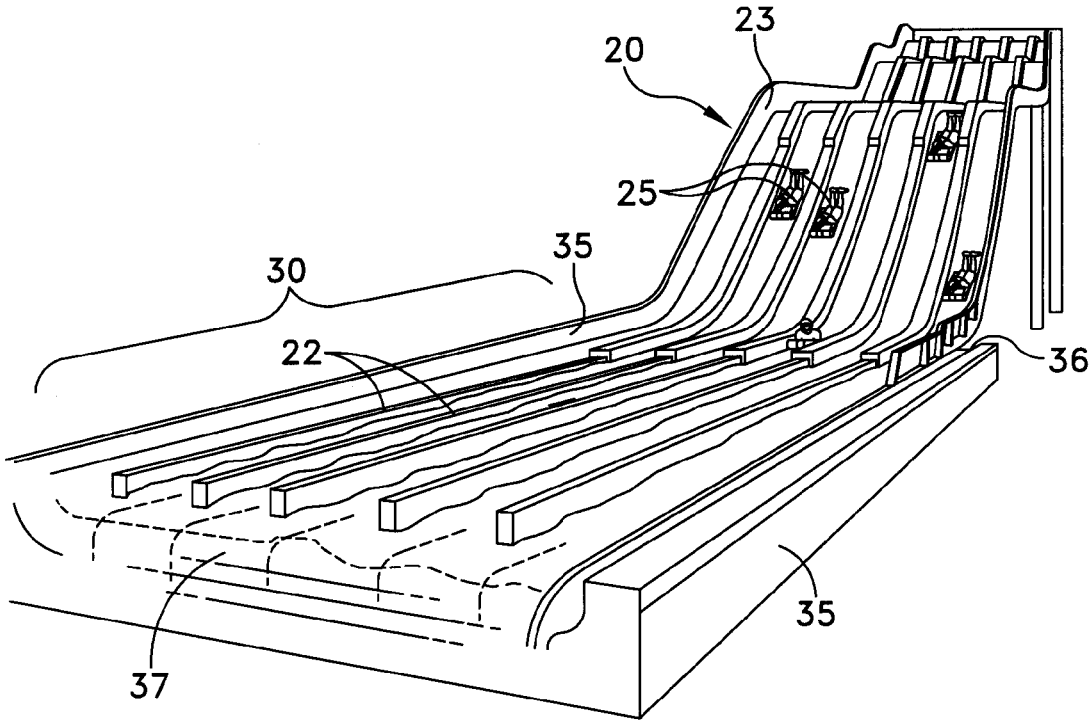
FIG. 3 is a perspective view showing the terminal area from the opposite end of the course.

Referring to FIGS. 1 and 2, the invention is applicable to a waterslide 20 having multiple lanes, for example with a wide support structure comprising molded fiberglass divided by curbs 22 into two or more lanes 23, six lanes being shown in this example. The waterslide lanes have a generally downhill gradient such that gravity impels the riders 25 down the course. The gradient can have changes in slope or even uphill sections that cause water to accumulate in one or more pooling areas that tend to slow the riders.

In the disclosed embodiment, the sliding course 20 proceeds continuously downwardly from a higher elevation to a lower elevation, with changes in slope. The course carries along water as well as the riders 25. At a minimum, the course has a low friction preferably-wetted surface for sliding over. Preferably, the course carries a continuous flow of water. In the exemplary embodiment 2,500 gallons per minute are distributed among the six lanes and flow from the top or beginning of the course to a pooling area 30 at the bottom or end, the water spilling over into a lower elevation water course 40.

The riders who use the course push off from the starting pool at the top of the course. In this example the riders 25 each slide on a sliding mat together with a continuous flow of water. Alternatives include sliding in an inflatable apparatus, sliding without any assisting apparatus (i.e., on skin and swimsuit), etc. Alternatives to a flowing current of water include spray wetting, injection of flow at strategic places, releasing gushes of water using an intermittent valve or movable weir (not shown), etc. These and other aspects are detailed in the patents listed in the foregoing section entitled prior art, and are applicable to the present invention.

According to the invention, at least one water pooling area is provided along the course. Preferably a pooling area 30 at the end of the course provides a so-called splash-down zone where the riders are stopped at the conclusion of the course. Optionally the pooling area could be at some intermediate point. Likewise, the pooling area can be more or less deep, and longer or shorter, depending on the velocity damping effect desired along the course.

Also, the provision of a pooling area and the dimensions of the pooling area can be different for different lanes, effectively providing faster and slower courses and/or more or less in the way of slowing at the conclusion. This can provide a choice adapted to accommodate more or less courageous riders. Preferably, however, the lanes have equal pooling areas and each lane has a pooling area at the conclusion of the ride, namely at splash-down pooling area 30.

A pooling area can be defined at any section of the course where water is available and the downhill gradient is interrupted by some sort of following uphill gradient structure. A U-shaped change in elevation forming a belly section of the course, or perhaps a ridge or weir or other such obstruction on a flat or gently downward slope can cause a pool to form.

Water at the pooling area accumulates by gravity to a depth defined by the height of the downhill obstruction, the pool extending backwards along the course by a horizontal distance determined by the slope of the course leading up to the obstruction. The object of the pooling area is to maintain a volume of standing water or slow moving water (i.e., moving more slowly than the rider or perhaps moving in a different direction from that of the rider). When a moving waterslide rider 25 encounters the pooling area, fluid drag slows the rider. The fluid drag is a function of the speed of the relative speed of the rider and the pooled water, then depth of immersion of the rider into the pool and similar factors. In the example of a pooling area at the end of the course, the object is to stop the rider, who then exits the ride making way for the next rider to arrive.

The sliding course 20 is subdivided into at least two lanes 22, such that two or more riders 25 can "race" or traverse the slide alongside another. The subdivision into lanes is particular useful at the pooling area 30 because it prevents collisions between the riders. In the preferred arrangement shown, the subdivision into lanes is by means of low curbs 22 between the lanes 23. More substantial intervening walls could be used instead of curbs 22. The intervening structures (e.g., the curbs) extend to a height above the nominal water level.

Inasmuch as the intervening structures subdivide the lateral width of the course into discrete lanes, the pooling water in any of the lanes can potentially have a different level from that of other lanes. Over time, additional water arriving in the lanes of the pooling area causes the lanes individually to fill and to overflow, thus equalizing the levels. However, equalizing the levels in that way takes time. If the riders are arriving over a shorter period than needed to refill and overflow all the lanes, the level in some lanes may be depleted when a rider arrives there.

In addition to rendering each lane a separate and discrete volume to be filled, the inclusion of curbs or other structures to define lanes reduces the dimensions of the open area at the lane to more nearly the same dimensions as the rider. The rider and sliding mat may fit the lane in a manner similar to a piston in a cylinder and have a mass that is comparable to the mass of the accumulated water in the corresponding lane of the pooling area 30. As a result, a rider encountering the pooling area at speed may displace a substantial part of the water from his/her respective ones of the lanes 23.

A rider sliding at full speed into the lane may splash water out of the lane and into adjacent lanes. The moving rider may develop a considerable wave front in the water in the lane, transferring the kinetic energy of the rider into a wave that washes forward and out of the pooling area 30. Finally, as mentioned above, if the rider has a large cross section compared to the lane dimensions, the rider may simply displace the water forward like a piston displaces fluid in its cylinder.

The amount of water that is nominally held in the pooling area is determined based on design considerations. Enough water needs to be maintained to have the required fluid drag based on the range of size of riders and the available run-out lane length. The run-out lane is preferably short and compact, if possible. The lanes should not fill and empty so frequently as to require a very substantial supply of water to each lane from flow along the course simply to replenish the run-out lanes. In worst case conditions of rider frequency, rider speed and rider size, sufficient water needs to be provided both to produce adequate fluid drag and to provide each rider with the desired "splash-down" sensation. A rider that closely follows another rider should not find little water present for drag, or skim across shallow water, or progress to far along the run-out lane, even to the far end.

According to an inventive aspect, one or more flow paths is provided to couple the pooling areas of at least two of the lanes so that the levels in the pooling areas of the coupled lanes are equalized by flow in either direction through such flow paths. The levels in the two or more coupled lanes assumes an average of the unequal levels that the coupled lanes would otherwise maintain separately. This provides more water more quickly in a depleted lane, in less time than would be needed to replenish a depleted lane from water flowing down the course. Several different structures are disclosed herein for achieving such conduit or flow paths connections.

Coupling the lane(s) 23 depleted of pooling water to other lanes tends to spread the effects of depletion of water in one lane to the other lanes. The depleted lane is replenished at the expense of the other lanes, but only as a matter of averaging. Thus, if three lanes are coupled and one lane is depleted by three inches depth, the equalizing coupling flow path(s) promptly replace two inches in the depleted conduit with one inch of depth from the two coupled conduits. All of the conduits are constantly being fed by water flowing along the course. As a result the depletion of water in any lane is ameliorated. The burden placed on other lanes is merely proportionate to the number of coupled lanes.

This effect is achieved by coupling at least two of the lanes by a conduit 52, by a gap along the length of curb 22, or by a clearance around an end of curb 22 at the termination of the run-out pooling area. Advantageously, three or more lanes are coupled together by large diameter piping. This arrangement is particularly useful to replenish in a situation where two "racing" riders may deplete adjacent lanes at the approximately the same time. The flow is driven simply by the fluid head produced by the difference in water levels between lanes.

FIGS. 3 through 7 show some of the particulars of the inventive waterslide in a preferred arrangement wherein the splash down pooling area is defined by a low box-shaped pool structure at the lowest elevation. This structure has side walls 35, a rear end wall 36 (best shown in FIG. 4) and a front lip or rim 37 over which the water overflows. The curbs 22 between lanes 23 extend for a distance into the splash down zone. The curbs 22 can extend clear to the lip 37, or alternatively, the curbs can extend only part way toward lip 37, leaving an end area at which the riders can walk laterally in front of the lanes without the danger of tripping over a curb 22. The area leading up to lip 37 has a sloping surface 38 that not only defines a barrier for pooling of water, but also provides a final barrier to a rider against sliding off the end of the course.

Water flows down the course in the lanes 23 from a higher elevation on the course and feeds into the pooling area 30. Excess water flows over lip 37 and can be collected, for example in a lower elevation sump such as a deep and slow moving "lazy river" attraction 40, shown in FIGS. 1, 2, 4 and 7.

Figure 4:
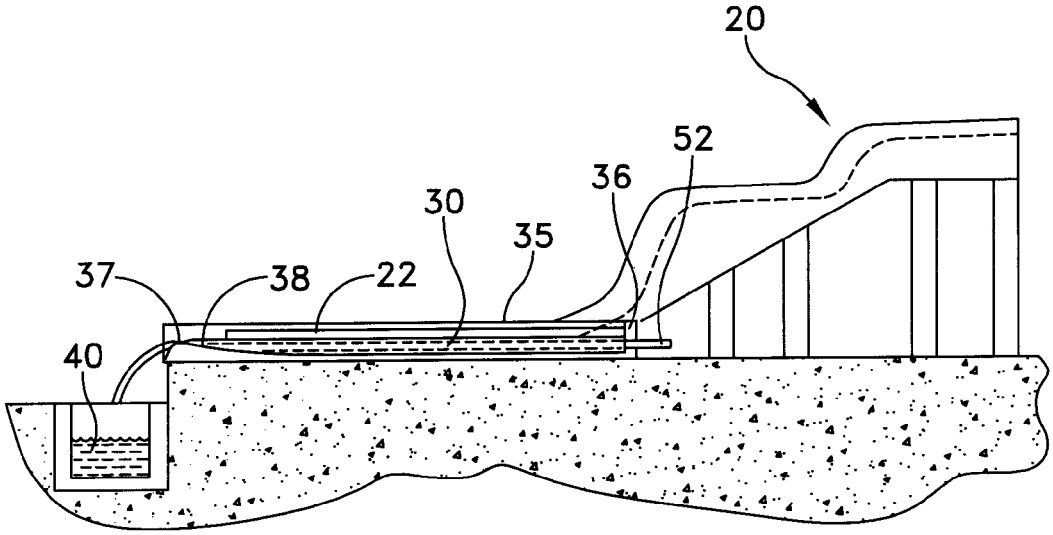
FIG. 4 is a partly sectional elevation view showing details of the terminal pool, including discharge of water over a lip into a collection watercourse.

In the embodiment shown in FIG. 4, two or more lanes of the pooling area are coupled by a conduit 52 disposed at the rear of the pooling area 30, namely behind the point at which the last downhill segment of the course joins the pooling area 30. The pooling area 30 in this case is a box-like pool structure into which the riders pass from a last downwardly inclined section of the course. FIG. 4 shows sectionally that the downstream end of the splash down area 30 terminates at a raised lip 37, over which water in the lanes overflows. The lip 37 is preceded by an upwardly sloping bottom surface 38 and forms the downstream obstruction that fixes the maximum depth of the water at a level that is below that of the pool structure outer side walls 35 and also lower than the height of the curbs 22 that subdivide the course into lanes 23.

Figure 5:
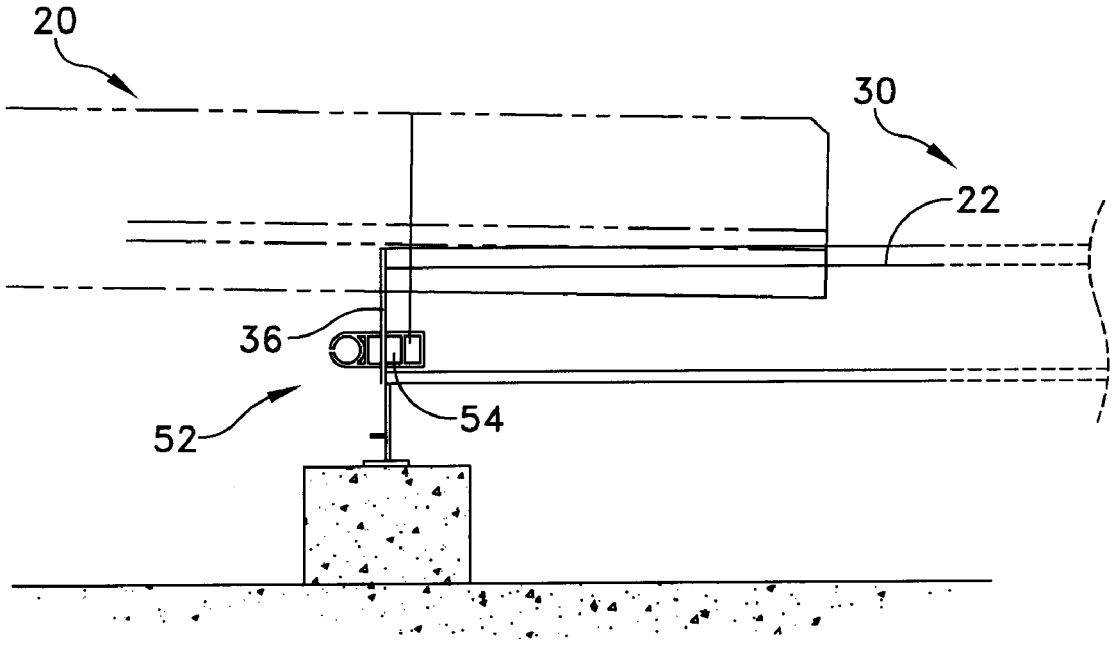
FIG. 5 is a partial elevation view in section, demonstrating equalizing conduits provided at a rear end of a terminal pool, representing a practical embodiment of subject matter also shown in FIG. 4.
Figure 6:
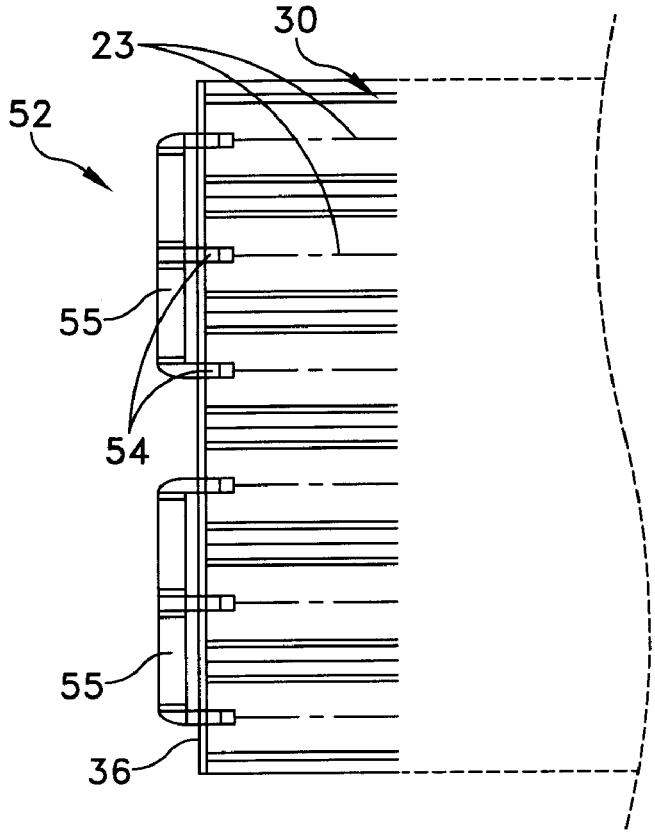
FIG. 6 is a partial elevation view showing the conduit portion of the embodiment in FIG. 5.
Figure 7:
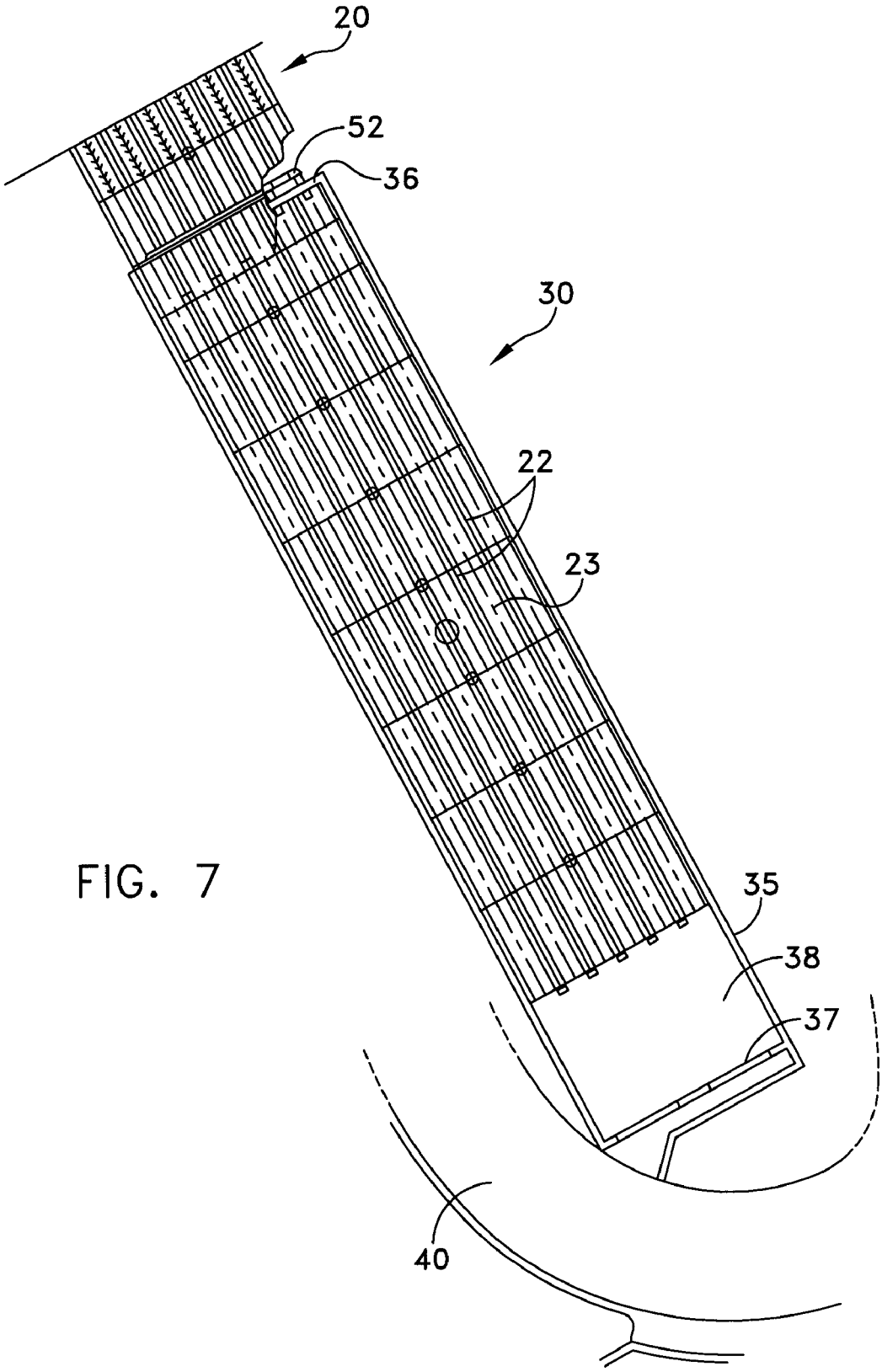
FIG. 7 is a plan drawing, detailing the waterslide shown in FIGS. 1 and 2, with the respective linear section shown to scale and each section shown in an elevation view, i.e., with the sliding course shown substantially flattened to a plane.

Riders arriving in area 30 splash water from their respective lane 23 into adjacent lanes and also sweep water forward from the pooling area over the drainage lip 37. As shown in FIGS. 4–6, a conduit 52 includes pipes that extend through the rear wall 36 of the pooling area box structure and provide a flow path between two or more of the lanes 23 between curbs 22. The conduit 52 can have snub ends 54 that extend through rear wall 36 and couple to manifold sections 55. The conduit 52 can comprise relatively large diameter PVC piping, for example four inch diameter pipe. Preferably, the pipe is disposed slightly above the bottom of the box structure, for example having a top edge at about five inches from the bottom.

The embodiment as shown in FIG. 6 has two independent leveling conduit sections 55, of which each has three members, coupled through the back wall 36 of the pool box. This arrangement is beneficial in that the replenishment of a lane is shared over three lanes and the mounting of the conduits is relatively easy. As alternative configurations, the conduits could couple through the underside of the pool box structure instead of through rear wall 36. All the lanes could be coupled together instead of two sets of coupled lanes as shown.

A replenishing flow between the lanes can be achieved by opening gaps in the curbs 22 that define lanes 22 so that water can pass between adjacent lanes. This can equalize between two lanes or more, namely by providing gaps that couple two adjacent lanes in the same area as gaps that couple one of those lanes to a next adjacent lane and so forth.

FIG. 4 also illustrates a technique for coupling lanes around the ends of curb 22. The pooling area has a bottom contour that slopes upwardly toward the drainage lip 37 at surface 38. In the embodiment shown, the curb 22 ends at a space from lip 37, leaving a depth of water over surface 38 and beyond curb 22 where water can pass around curb 22 and replenish an adjacent lane. A similar arrangement can be obtained where there is a gap along the length of curb 22 through which water can flow between adjacent lanes 23 (not shown). Such a gap should be carefully constructed, possibly covered with a grill or the like, and generally made without a protrusion that the rider might contact.

In the embodiment shown, the entire course can be made of molded segment. The lanes 23 between curbs 22 are substantially continuous from the higher elevation to the lower elevation. However, as shown in FIG. 5, the course can include a discontinuous overlap of the last downward incline into the pooling area box where equalization conduit 52 is connected. By concealing conduits 52 in this way, the conduits can be relatively large. A similar effect can be had, or an additional effect, by including a gap between the rear ends of curbs 22 and the rear wall 36 of the pooling area box (not shown).

The invention is applicable to various sorts of waterside attractions having at least two lanes that end in sufficient proximity to enable convenient coupling with an equalization flow conduit 52. In the preferred arrangement, the lanes 23 from the higher elevation to the lower elevation are substantially coextensive, whereby riders can traverse the sliding course contemporaneously, i.e., to race one another. This is advantageous when the lanes are laterally adjacent. The lanes could trace any route, however, and come together at the splash down pooling area to benefit from the flow equalization aspects described.

The invention has been described with respect to certain embodiments considered advantageous, but is not intended to be limited only to these embodiments. Reference should be made to the appended claims as opposed to the foregoing description of preferred embodiments, to assess the invention in which exclusive rights are claimed.

What is claimed is:

1. A waterslide comprising:

a sliding course for riders proceeding from a higher elevation to a lower elevation;

at least one water pooling area along the course, wherein water at The pooling area accumulates by gravity to a depth providing fluid drag for slowing the riders when encountering the water pooling area;

wherein the sliding course is subdivided into lanes at said pooling area, and wherein a rider encountering the pooling area can displace water from a respective one of the lanes, to a level less than a level of water in another one of the lanes;

at least one flow conduit coupling between the lanes at The pooling area, the flow conduit carrying a flow between the lanes in the pooling area, whereby the levels of water in the lanes of the pooling area are better equalized;

wherein the pooling area is disposed at an end of the sliding course as a splash down area;

wherein the pooling area continues to a drainage end having an elevation normally defining The level of the water therein, and wherein arriving riders sweep water from the pooling area over the drainage end; and, wherein the pooling area has a bottom contour that slopes upwardly toward the drainage end.

2. The waterslide of claim 1, comprising at least one curb between the lanes and wherein a gap is defined in the curb leading to the drainage end.

3. The waterslide of claim 2, wherein the flow conduit comprises at least one of a gap in the curb, a gap around an end of the curb and a conduit connecting between at least two of the lanes.

4. A waterslide comprising: a sliding course for riders proceeding from a higher elevation to a lower elevation;

at least one water pooling area along the course, wherein water at the pooling area accumulates by gravity to a depth providing fluid drag for slowing the riders when encountering the water pooling area;

wherein the sliding course is subdivided into lanes at said pooling area, and wherein a rider encountering the pooling area can displace water from a respective one of the lanes, to a level less than a level of water in another one of the lanes;

at least one flow conduit coupling between the lanes at the pooling area, the flow conduit carrying a flow between the lanes in the pooling area, whereby the levels of water in the lanes of the pooling area are better equalized;

wherein the pooling area is defined between side walls and end walls, the side walls being arranged laterally outside outermost ones of the lanes, the sidewalls extending parallel to curbs That subdivide the pooling area into a plurality of said lanes between the sidewalls, and wherein at least one of the end walls has an elevation determining the level of water in the pooling area for at least one of the lanes; and, a second end wall opposite from the drainage end, and wherein the sliding course defines a sloping entry for the riders into the pooling area at a point between the end walls.

5. The waterslide of claim 4, wherein the conduit couples between at least two lanes behind said sloping entry, whereby flow from the conduit follows behind the riders.

6. A waterslide comprising:

a sliding course for riders proceeding from a higher elevation to a lower elevation;

at least one water pooling area along the course, wherein water at the pooling area accumulates by gravity to a depth providing fluid drag for slowing the riders when encountering the water pooling area;

wherein the sliding course is subdivided into lanes at said pooling area, and wherein a rider encountering the pooling area can displace water from a respective one of the lanes, to a level less than a level of water in another one of the lanes;

at least one flow conduit coupling between the lanes at the pooling area, the flow conduit carrying a flow between the lanes in the pooling areas whereby the levels of water in the lanes of The pooling area are better equalized;

wherein the pooling area is defined between side walls and end walls, the side walls being arranged laterally outside outermost ones of the lanes, the sidewalls extending parallel to curbs that subdivide the pooling area into a plurality of said lanes between the sidewalls, and wherein at least one of the end walls has an elevation determining the level of water in the pooling area for at least one of the lanes; and, a second end wall opposite from the drainage end, and wherein the flow conduit couples between at least two lanes adjacent to the second end wall.

* * * * *